US006030112A

United States Patent [19]

Milek

[11] Patent Number: 6,030,112

[45] Date of Patent: Feb. 29, 2000

[54] SLURRY BATCHER MIXER

[76] Inventor: Robert C. Milek, 6560 Stones Throw Dr., Omaha, Nebr. 68152

[21] Appl. No.: 09/073,790

[22] Filed: May 6, 1998

[51] Int. Cl.[7] ..... B28C 15/14

[52] U.S. Cl. ..... 366/64; 366/320

[58] Field of Search ..... 366/320, 318, 366/601, 64, 13, 33, 34, 40, 168.1, 172.1, 172.2, 241, 279

[56] References Cited

U.S. PATENT DOCUMENTS

| | | | |
|---|---|---|---|
| 746,664 | 12/1903 | Bourdeau | 366/320 |
| 3,459,409 | 8/1969 | Goldberger | 366/64 |
| 3,469,824 | 9/1969 | Futty et al. | 366/64 |
| 4,194,925 | 3/1980 | Holbrook et al. | 366/64 |
| 4,205,919 | 6/1980 | Attwell | 366/320 |
| 4,551,024 | 11/1985 | Clapp | 366/64 |
| 4,637,731 | 1/1987 | Dahlin | 366/320 |
| 4,812,048 | 3/1989 | Neumann et al. | 366/141 |
| 5,186,840 | 2/1993 | Christy et al. | 366/320 |
| 5,228,775 | 7/1993 | Horn et al. | 366/320 |
| 5,580,170 | 12/1996 | Holley et al. | 366/64 |

FOREIGN PATENT DOCUMENTS

| | | | |
|---|---|---|---|
| 1054811 | 5/1954 | Germany | 366/320 |
| 2819669 | 11/1979 | Germany | 366/64 |
| WO 83/01910 | 6/1983 | WIPO | 366/320 |

*Primary Examiner*—Tony G. Soohoo
*Attorney, Agent, or Firm*—Zarley, McKee, Thomte, Voorhees & Sease; Dennis L. Thomte

[57] ABSTRACT

The slurry batcher mixer of the present invention includes a mixing vessel having a pair of vertical side plates with a trough supported along the length of the vessel between the side plates. A ribbon type screw conveyor is mounted in the trough and extends the length of the mixing vessel, and is connected to a reversible drive motor to selectively rotate the screw in a first direction to convey material to a discharge port, or in the opposite direction to provide a positive thorough mixing of the contents of the mixing vessel. A source of fly ash, cement, and water is provided to the mixing vessel, and a pair of spray bars are mounted on the side plates with nozzles directed towards the screw, to spray water along the length of the screw.

11 Claims, 5 Drawing Sheets

SLURRY BATCHER MIXER

TECHNICAL FIELD

The present invention relates generally to mixing apparatus for cementitious materials, and more particularly to an improved batcher mixer for mixing dry materials and water or other liquids.

BACKGROUND OF THE INVENTION

In the batching of the materials for concrete, the cementitious materials such as portland cement and fly ash are normally proportioned by weight accumulatively in a suspension hopper scale. This free fall from overhead storage or from conveyors results in considerable dusting of materials as air is displaced within the weigh hopper. There is further dusting of the cementitious materials as they are released from the weigh hopper and combined with aggregate materials and water to form concrete in a mixer. This exhausting of dust due to the dry batching of materials is a contaminant to the environment and must be filtered or drawn to a bag house for confinement and recycling.

Normally, suspension hopper scales for cementitious materials are located beneath a storage silo and having a cone shaped or pyramidal base are excessively high in vertical dimensions so as to contain the necessary volume of materials. The mixing of a slurry of cementitious materials and water is normally accomplished in a separate vessel.

SUMMARY OF THE INVENTION

It is an object of the invention to provide a batching and mixing system for either dry cementitious materials or to combine the same with water to form a slurry and to convey the mixed ingredients to a mixer for combination with aggregate materials.

It is still another object of the invention to provide a system for mixing cementitious materials and water into a slurry to provide more thorough mixing, to prevent formation of cement balls, and to shorten the time required to thoroughly mix the cementitious slurry with aggregate materials in a concrete mixer.

It is another object of the invention to equip the weigh hopper with water spray jets to combine water with dust particles to reduce the need for a complicated and expensive dust filtering system.

It is still another object of the invention to provide a more positive mixing system by employing a conventional ribbon-type screw conveyor which historically has been utilized for mixing materials of a sticky nature.

It is another object of the invention to provide a horizontally disposed vessel of reduced vertical dimensions which will weigh and mix either dry materials or a cement and water slurry and to convey the mixed materials horizontally and downwardly to a mixer means outside the support structure.

It is still another object of the invention to equip the mixing vessel with a close fitting rubber trough to ensure mixing and discharge of all materials.

It is still another object of the invention to provide a reversible drive mechanism to mix upward in one direction and downward in the opposite direction for faster discharge.

These and other objects of the present invention will be apparent to those skilled in the art.

The slurry batcher mixer of the present invention includes a mixing vessel having a pair of vertical side plates with a trough supported along the length of the vessel between the side plates. A ribbon type screw conveyor is mounted in the trough and extends the length of the mixing vessel, and is connected to a reversible drive motor to selectively rotate the screw in a first direction to convey material to a discharge port, or in the opposite direction to provide a positive thorough mixing of the contents of the mixing vessel. A source of fly ash, cement, and water is provided to the mixing vessel, and a pair of spray bars are mounted on the side plates with nozzles directed towards the screw, to spray water along the length of the screw.

DESCRIPTION OF THE PREFERRED EMBODIMENT

Figure 1:
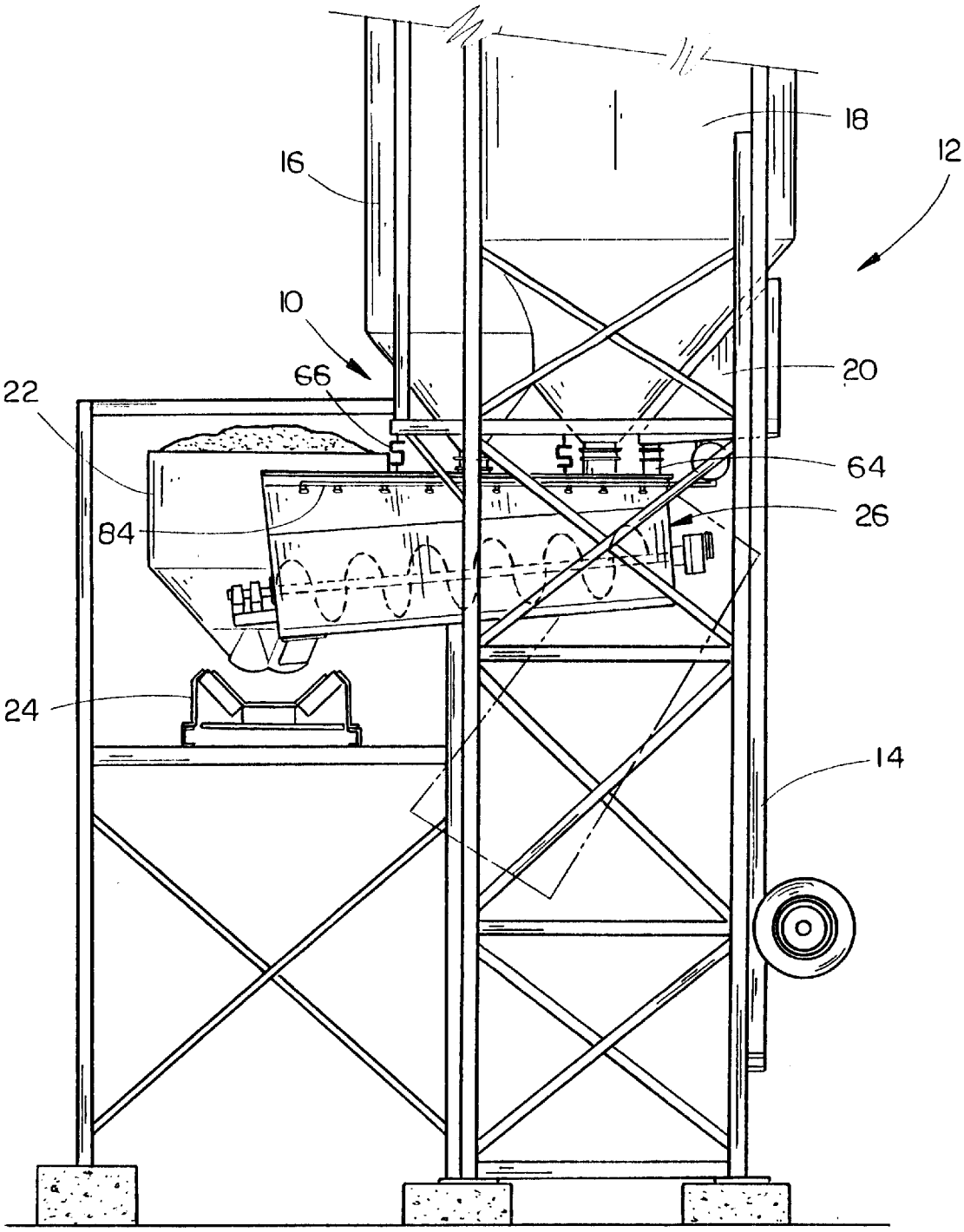
FIG. 1 is an elevational view of the batcher mixer of the present invention in position on a portable concrete batch plant.

Referring now to the drawings, in which similar or corresponding parts are identified with the same reference numeral, and more particularly to FIG. 1, the slurry batcher mixer of the present invention is designated generally at 10 and is shown installed on a portable concrete batch plant 12. Batch plant 12 includes a frame 14 for supporting a fly ash storage tank 16, a cement storage tank 18, a water holding tank 20, batcher mixer 10, aggregate hopper 22, and a conveyor 24.

Referring now to FIGS. 2–6, the batcher mixer of the present invention includes a mixing vessel 26 having first and second generally vertical end panels 28 and 30, with opposing generally vertical side panels 32 and 34 extending therebetween. The lower edges of side panels 32 and 34 support a generally U-shaped trough 36 which extends from first end panel 28 to second end panel 30. Trough 36 is preferably formed of a resilient rubber-like material.

A ribbon type screw conveyor 38, with a spiral flighting 40 and a central drive shaft 42 is mounted between end panels 28 and 30 with flighting 40 in close slidable engagement with trough 36. Drive shaft 42 is mounted in bearings 44 and 46 on end panels 30 and 28 respectively, and has a drive motor 48 (shown in FIGS. 2 and 4) to selectively rotate conveyor 38 in either direction.

Figure 5:
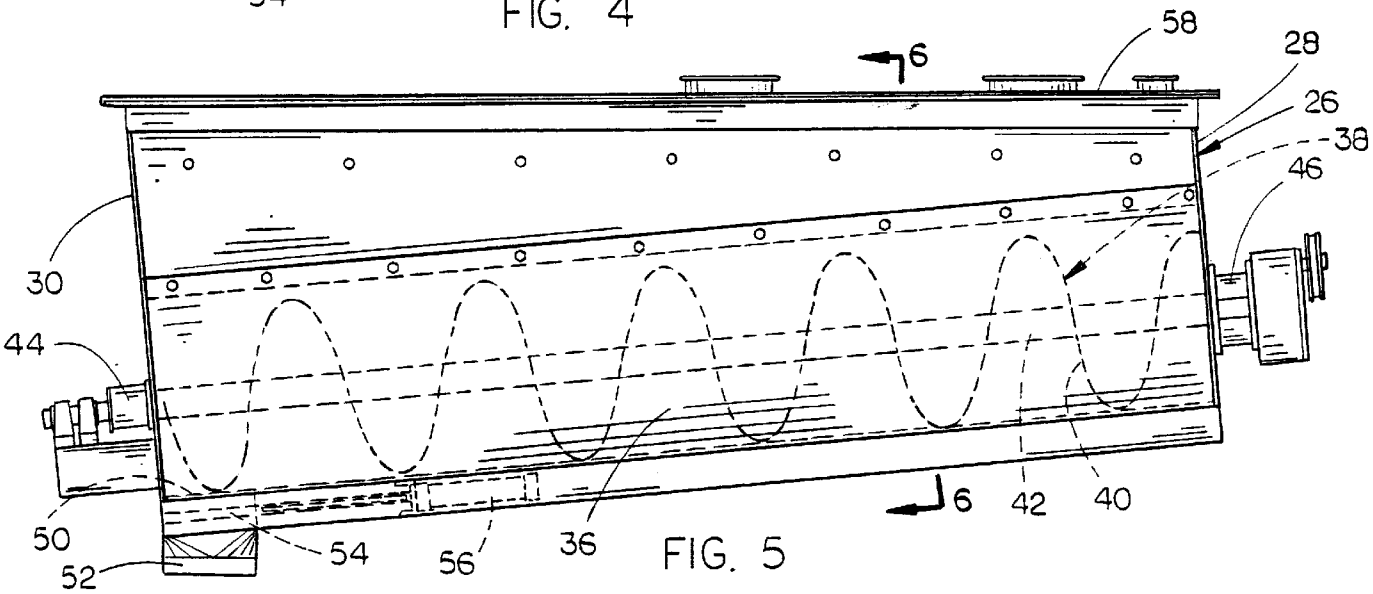
FIG. 5 is a front elevational view of the batcher mixer.
Figure 6:
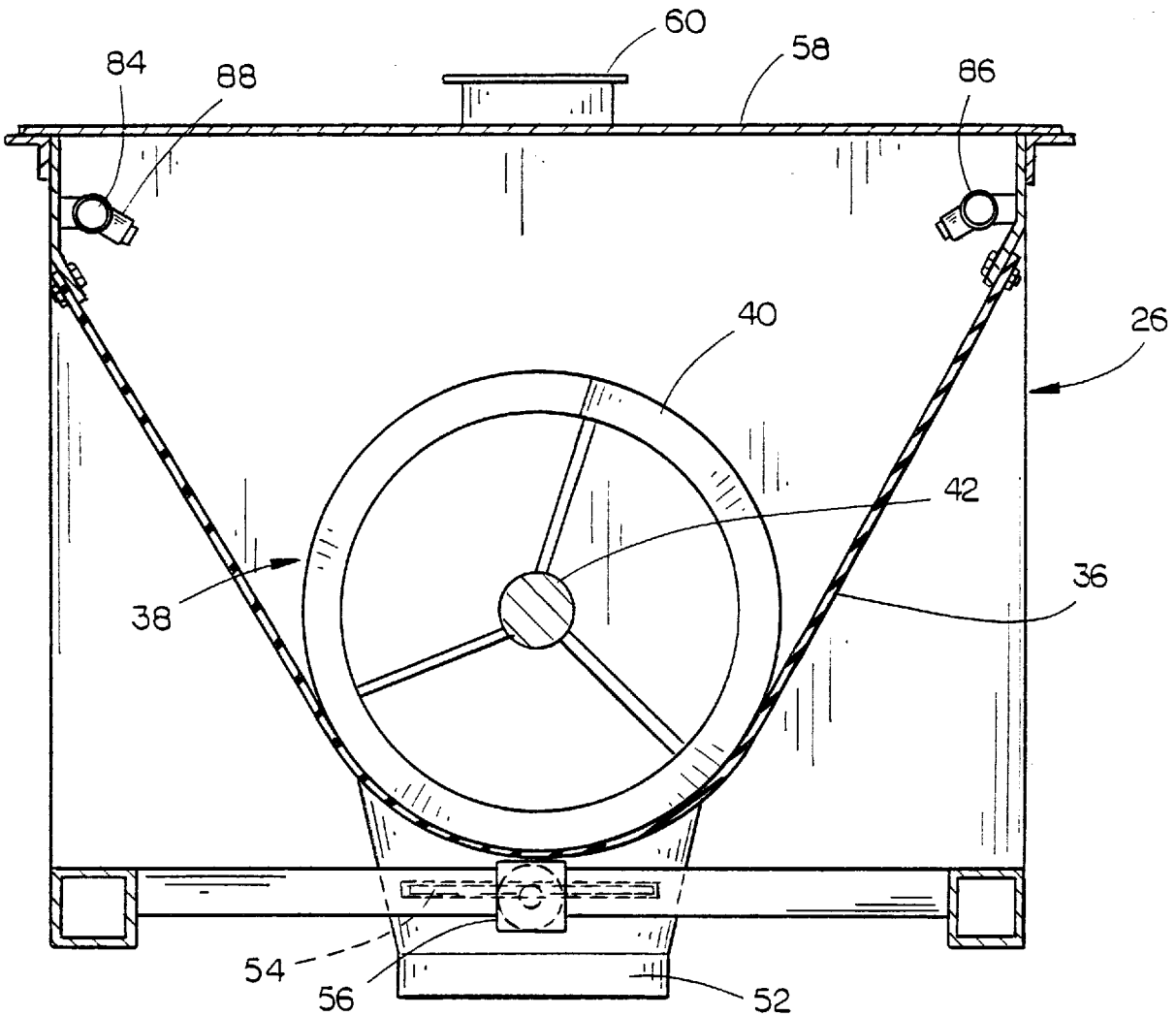
FIG. 6 is an enlarged sectional view taken at lines 6—6 in FIG. 5.

Referring now to FIG. 5, it is preferred that trough 36 be mounted at a sloped incline, downwardly from the first end panel 28 to the second end panel 30. An opening 50 in the bottom of trough 36 at the lower end is disposed above a discharge chute 52, to permit the discharge of the contents of trough 36. A slide gate 54 is selectively operated by a cylinder 56 to open and close access to discharge chute 52.

Figure 4:
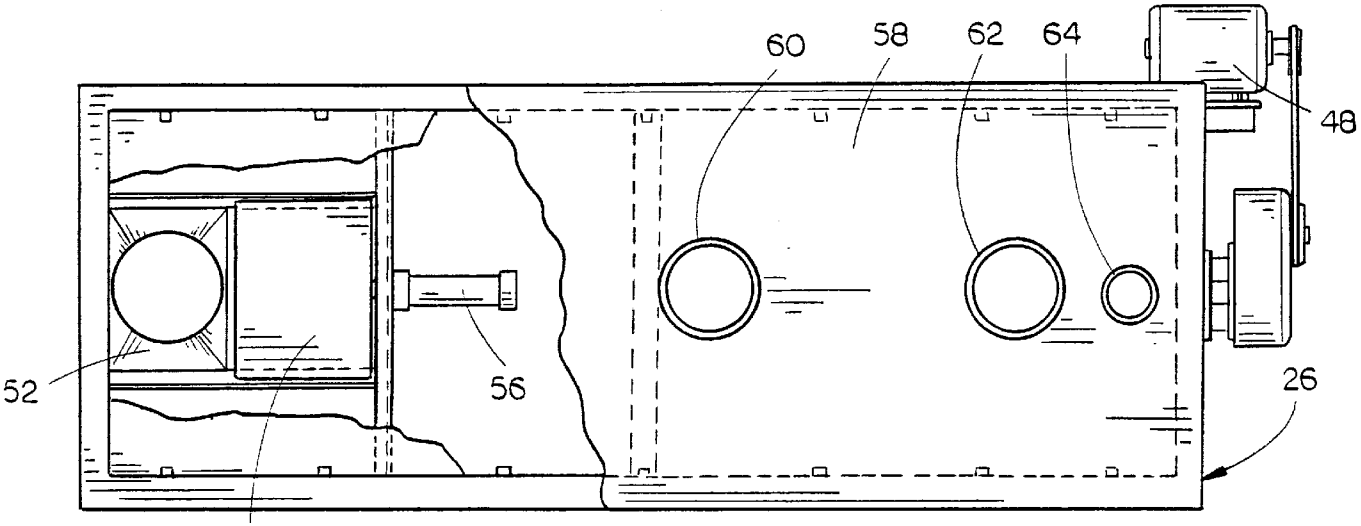
FIG. 4 is a top view of the batcher mixer, with portions cut away to show underlying details.

As shown in FIGS. 4 and 5, a cover plate 58 covers the entire upper end of mixing vessel 26, to contain dust and materials during the mixing process. Cover plate has three inlets 60, 62, and 64 formed therein. The first inlet 60 is connected to fly ash tank 16, to supply fly ash to mixing vessel 26. Second inlet 62 is connected to cement tank 18 to supply cement material to the mixing vessel 26. Finally, third inlet 64 is connected to water storage tank 20 to supply water to mixing vessel 26.

Figure 2:
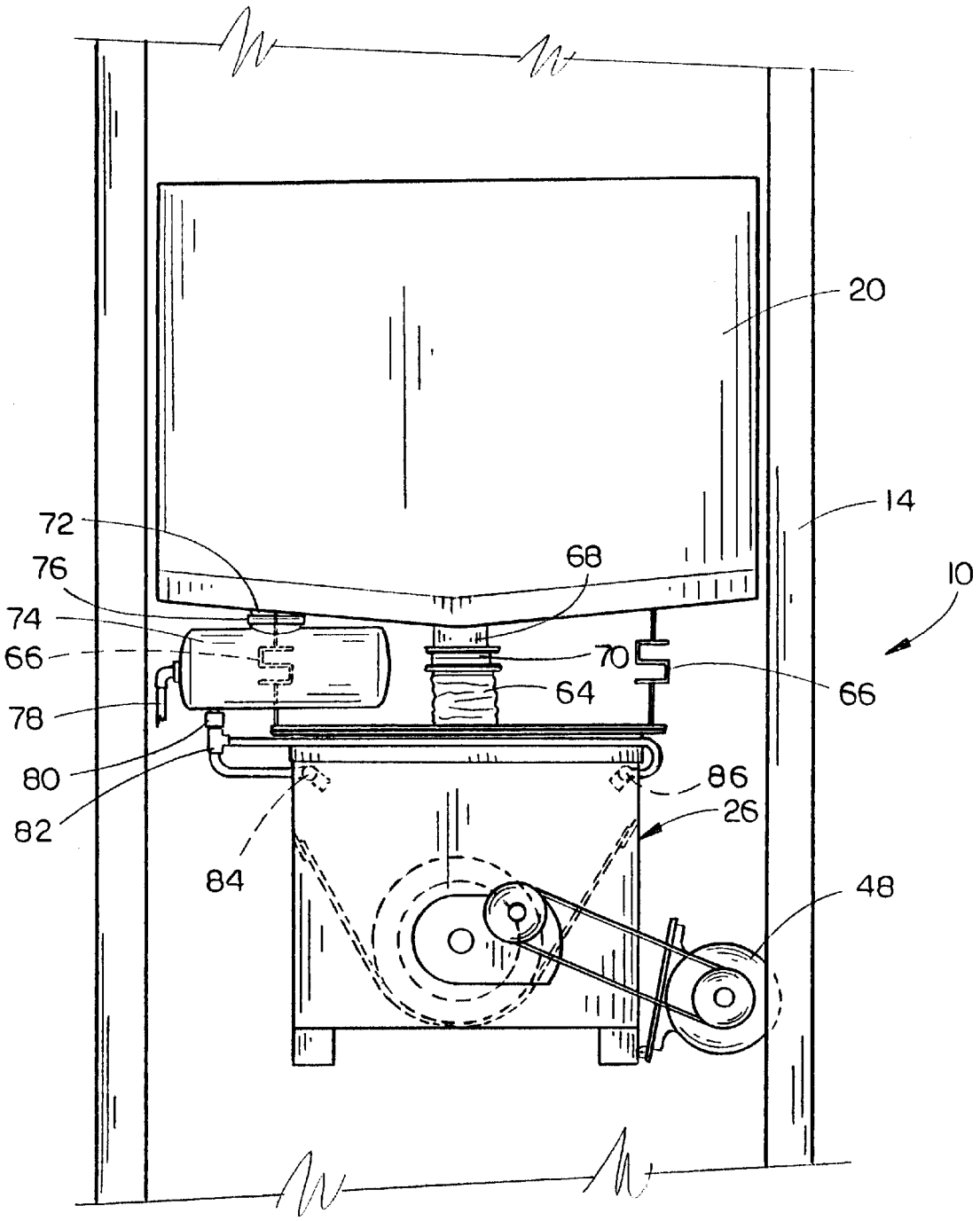
FIG. 2 is an enlarged elevational view of the invention, taken from the right side of FIG. 1.
Figure 3:
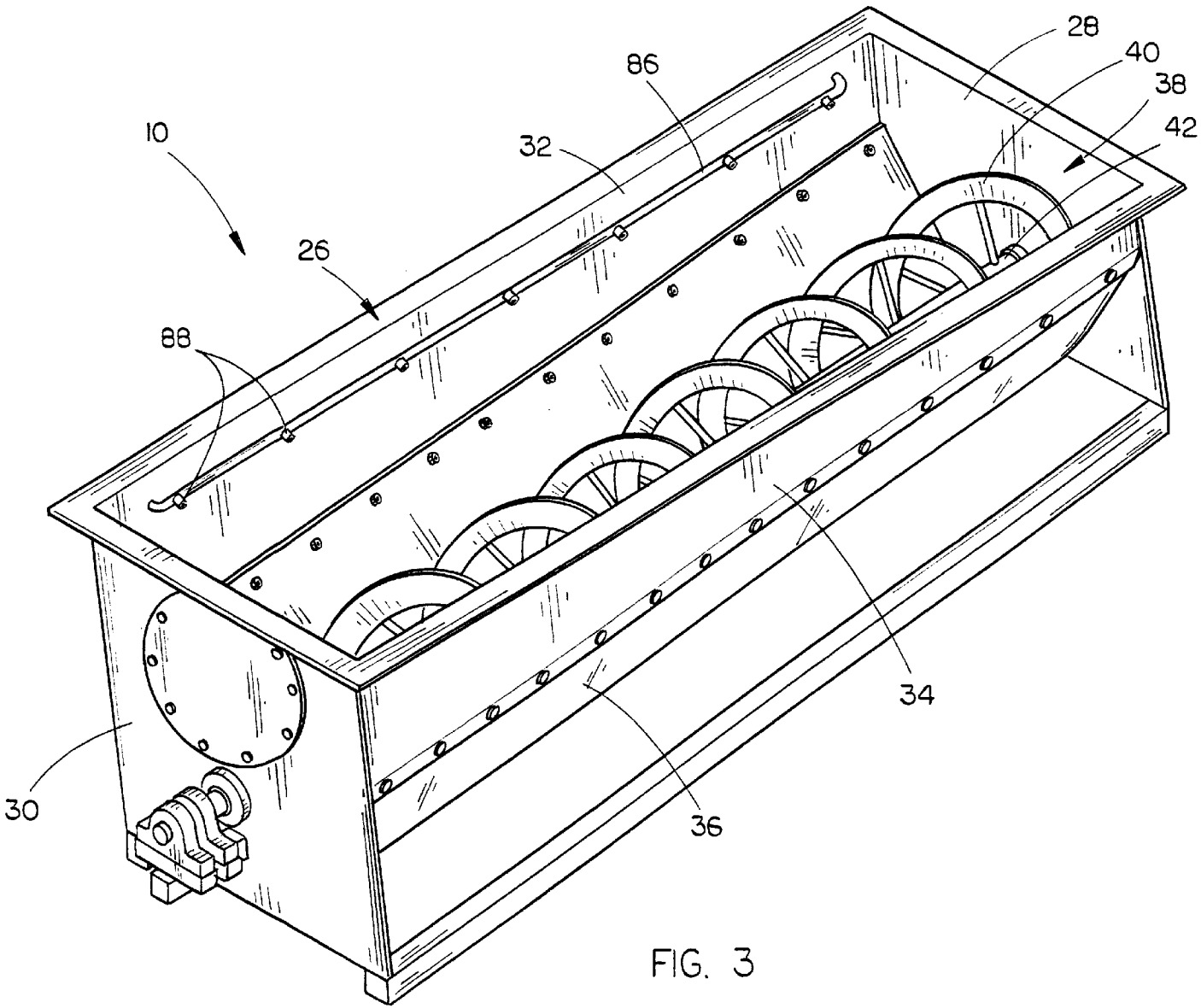
FIG. 3 is a perspective view of the batcher mixer of the present invention.

As shown in FIG. 2, mixing vessel 26 is suspended from frame 14 by a plurality of weigh devices 66, to permit continuous detection of the weight of materials supplied to the mixing vessel 26. Water storage tank 20 has a main supply conduit 68 connected to third inlet 64 through a valve 70, to selectively supply water to mixing vessel 26. An auxiliary outlet 72 is also formed in the bottom of water tank 20 to supply water to a pressure tank 74 via valve 76. A pneumatic line 78 is connected to a source of air pressure, to pressurize tank 74 to discharge water from the tank. Water from pressure tank 74 is piped through a second valve 80 and a tee 82 and thence to a pair of opposing spray bars 84 and 86 arranged along the longitudinal sides of mixing vessel 26. Water under pressure from tank 74 will thereby be sprayed from spray bars 84 and 86 within mixing vessel 26 to reduce any dusting and assist in the mixing process. Spray bar 86 is shown in more detail in FIG. 3, and includes a plurality of spray nozzles 88 spaced uniformly along the entire length of the spray bar. Spray bar 84 is similar in structure.

In operation, dry material will first be supplied to the mixing vessel 26 from fly ash tank 16 and cement tank 18, as shown in FIG. 1. The weight of the dry materials is measured by the supporting weigh devices 66, in a conventional fashion. The mixing screw 38 is operated to mix the dry materials within the mixing vessel 26, by rotating the drive shaft 42 in a first direction, which attempts to carry the materials from the lower end of the trough to the upper end of the trough. A predetermined quantity of water may be added simultaneously from water tank 20 via the water inlet 64 and spray bars 84 and 86. Once the dry and wet materials have been mixed to a slurry of the desired consistency, the slide gate 54 (shown in FIG. 4) is opened to discharge the slurry from the mixing vessel on to conveyor 24, or directly into a concrete mixer for combining with aggregate or the like.

Whereas the invention has been shown and described in connection with the preferred embodiment thereof, many modifications, substitutions and additions may be made which are within the intended broad scope of the appended claims.

I claim:

1. A batching and mixing apparatus, comprising:

a mixing vessel having first and second ends, a pair of generally vertical side plates extending between the end, and a trough supported along the side plates and extending from the first end to the second end;

a cover plate extending across a top of the mixing vessel to enclose the top of the mixing vessel and including a first inlet port therein for permitting the flow of a first material comprising a dust-producing particulate into the enclosed mixing vessel;

a discharge port formed in the trough proximal the second end, with an operable discharge gate therein, operable between an open position and a closed position;

a ribbon type screw conveyor operably mounted in the trough and extending from the first end to the second end of the trough, said conveyor including a spiral flighting with an outer edge and an inward edge, the outward edge in slidable engagement with the trough;

an elongated spray bar mounted on one of said side plates along a length of the mixing vessel substantially from the first end to the second end, the spray bar having a plurality of spaced-apart spray nozzles thereon directed towards the screw conveyor; whereby a liquid sprayed through the spray nozzles moistens the first material and reduces the production of dust; and a reversible drive motor connected to the conveyor for selectively rotating the conveyor in first and second directions.

2. The apparatus of claim 1, wherein said trough slopes downwardly from the first end of the mixing vessel to the second end of the mixing vessel.

3. The apparatus of claim 2, wherein said trough is formed of a resilient, flexible material.

4. The apparatus of claim 3, wherein said cover plate includes a second inlet port therein for permitting the flow of a second material into the enclosed mixing vessel, independently of the first inlet port.

5. The apparatus of claim 4, further comprising a third inlet port in the cover plate, for permitting the flow of a third material into the enclosed mixing vessel, independently of the first and second inlet ports.

6. The apparatus of claim 5, wherein the first inlet port is connected to a source of fly ash, wherein the second inlet port is connected to a source of cement, and wherein the third inlet port is connected to a source of water.

7. The apparatus of claim 6, wherein said spray nozzles are uniformly spaced along the spray bar from the first end to the second end of the mixing vessel.

8. The apparatus of claim 7, further comprising a second spray bar mounted on a side plate opposing the first spray bar, and including a plurality of spray nozzles spaced apart along the second spray bar.

9. The apparatus of claim 1, wherein said trough is formed of a resilient, flexible material.

10. The apparatus of claim 1, further comprising at least one weigh device supporting the mixing vessel on a support frame.

11. A batching and mixing apparatus, comprising:

a mixing vessel having first and second ends, a pair of generally vertical side plates extending between the ends, and a trough supported along the side plates and extending from the first end to the second end;

a discharge port formed in the trough proximal the second end, with an operable discharge gate therein, operable between an open position and a closed position;

a ribbon type screw conveyor operably mounted in the trough and extending from the first end to the second end of the trough, said conveyor including a spiral flighting with an outer edge and an inward edge, the outward edge in slidable engagement with the trough;

a reversible drive motor connected to the conveyor for selectively rotating the conveyor in first and second directions;

said trough sloping downwardly from the first end of the mixing vessel to the second end of the mixing vessel; and being formed of a resilient, flexible material;

a cover plate extending across the top of the mixing vessel to enclose the top of the mixing vessel;

said cover plate including a first inlet port therein for permitting the flow of a first material into the enclosed mixing vessel;

said cover plate including a second inlet port therein for permitting the flow of a second material into the enclosed mixing vessel, independently of the first inlet port;

said cover plate including a third inlet port therein for permitting the flow of a third material into the enclosed mixing vessel, independently of the first and second inlet ports;

the first inlet port being connected to a source of fly ash, the second inlet port being connected to a source of cement, and the third inlet port being connected to a source of water;

an elongated spray bar mounted along a length of the mixing vessel substantially from the first end to the second end, the spray bar having a plurality of spaced-apart spray nozzles thereon directed towards the screw conveyor; and a pressure tank in fluid communication with, and interposed between, the spray bar and the water source, said pressure tank including an operable inlet valve and an operable outlet valve, said tank being connected to a source of air pressure, to selectively pressurize the tank.

* * * * *